US011827325B1

(12) United States Patent
Przybyl et al.

(10) Patent No.: US 11,827,325 B1
(45) **Date of Patent: *Nov. 28, 2023**

(54) METHODS AND SYSTEMS FOR CONTROLLING TRIM POSITION OF A MARINE DRIVE

(71) Applicant: Brunswick Corporation, Mettawa, IL (US)

(72) Inventors: Andrew J. Przybyl, Berlin, WI (US); Kyle F. Karnick, Fond du Lac, WI (US); Mark A. Graf, Fond du Lac, WI (US); Jeffrey D. Reifsnyder, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/585,269

(22) Filed: Jan. 26, 2022

Related U.S. Application Data

(63) Continuation of application No. 17/021,697, filed on Sep. 15, 2020, now Pat. No. 11,260,946.

(51) Int. Cl.

| | |
|---|---|
| ***B63H 20/10*** | (2006.01) |
| ***B63B 39/06*** | (2006.01) |
| ***F02B 61/04*** | (2006.01) |
| ***B63H 20/00*** | (2006.01) |

(52) U.S. Cl.
CPC ..... *B63H 20/10* (2013.01); *B63B 39/061* (2013.01); *B63H 2020/003* (2013.01); *F02B 61/045* (2013.01)

(58) Field of Classification Search
CPC ..... B63H 20/10; B63H 2020/003; B63B 39/061; F02B 61/045
See application file for complete search history.

(56) References Cited

U.S. PATENT DOCUMENTS

| | | | |
|---|---|---|---|
| 4,749,926 | A | 6/1988 | Ontolchik |
| 9,290,252 | B1 | 3/2016 | Tuchscherer et al. |
| 9,290,525 | B2 | 3/2016 | Abe et al. |
| 9,598,160 | B2 | 3/2017 | Andrasko et al. |
| 9,745,036 | B2 | 8/2017 | Andrasko et al. |

(Continued)

OTHER PUBLICATIONS

U.S. Appl. No. 17/585,273, filed Jan. 26, 2022, Methods and Systems for Controlling Trim Rate of Trimmable Marine Devices With Respect to a Marine Vessel, Office Action dated Oct. 5, 2022.

*Primary Examiner* — Stephen P Avila
(74) *Attorney, Agent, or Firm* — ANDRUS INTELLECTUAL PROPERTY LAW, LLP

(57) ABSTRACT

A method of automatically controlling trim position of a marine drive with a control system on a marine vessel includes receiving a user-selected command associated with wake surfing and then controlling a trim actuator to automatically position the marine drive in a tucked position, tucked position is between a vertical trim position and a minimum running trim position. Once a vessel condition of the marine vessel reaches a first threshold vessel condition the trim actuator is controlled to trim up the marine drive to a predetermined target trim position to generate wave behind the marine vessel. The first threshold vessel condition is at least one of a threshold vessel speed, a threshold engine speed, a threshold engine load, and a threshold vessel pitch.

19 Claims, 7 Drawing Sheets

(56) References Cited

U.S. PATENT DOCUMENTS

| | | | | |
|---|---|---|---|---|
| 9,751,605 | B1 | 9/2017 | Anschuetz et al. | |
| 9,764,810 | B1 | 9/2017 | Andrasko et al. | |
| 9,908,606 | B1 | 3/2018 | Andrasko et al. | |
| 9,919,781 | B1 | 3/2018 | Andrasko et al. | |
| 9,937,984 | B2 | 4/2018 | Herrington et al. | |
| 10,137,971 | B2 | 11/2018 | Andrasko et al. | |
| 10,351,221 | B1 | 7/2019 | Anscuetz et al. | |
| 11,260,946 | B1 * | 3/2022 | Przybyl | B63H 20/10 |
| 2010/0094491 | A1 | 4/2010 | Oehlgrien et al. | |
| 2011/0143608 | A1 | 6/2011 | Chiecchi | |
| 2016/0375972 | A1 | 12/2016 | Andrasko et al. | |
| 2018/0050780 | A1 | 11/2018 | Anschuetz | |

* cited by examiner

METHODS AND SYSTEMS FOR CONTROLLING TRIM POSITION OF A MARINE DRIVE

CROSS REFERENCE TO RELATED APPLICATION

This application is a continuation of U.S. patent application Ser. No. 17/021,697, filed Sep. 15, 2020, the contents of which is hereby incorporated by reference in its entirety.

FIELD

The present disclosure generally relates to systems and methods for controlling trim position of trimmable propulsion devices, and more particularly to methods and systems of controlling trim position of a marine drive on a marine vessel for providing improved conditions for wake surfing.

BACKGROUND

The following U.S. patents and patent applications are hereby incorporated herein by reference.

U.S. Pat. No. 9,290,252 discloses systems and methods for controlling trim position of a marine propulsion device on a marine vessel. The system comprises a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions. A controller is configured to adapt the amount of voltage to the electromagnet based upon at least one condition of the system.

U.S. Pat. No. 9,751,605 discloses a method for controlling a trim system on a marine vessel includes receiving an actual trim position of a trimmable marine device at a controller and determining a trim position error by comparing the actual trim position to a target trim position with the controller. The method also includes determining an acceleration rate of the marine vessel. In response to determining that the trim position error exceeds a first error threshold and the magnitude of the acceleration rate exceeds a given rate threshold, the controller commands the marine device to the target trim position. In response to determining that the trim position error exceeds the first error threshold and the acceleration rate does not exceed the given rate threshold, the controller commands the marine device to a setpoint trim position that is different from the target trim position. An associated system is also disclosed.

U.S. Pat. No. 9,919,781 discloses systems and methods disclosed herein control position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position, and a difference between the target trim position and the actual trim position is outside of a given deadband.

U.S. Pat. No. 9,937,984 discloses a wake control system aft of the driveshaft, propeller, and rudder of a vessel that includes a fin base and at least one fin slidingly engaged with the fin base. The fin(s) are vertically oriented and extend down into the water surface. The fins are transversely adjustable along the fin base to redirect a wake generated by the boat. In other embodiments, the control system comprises a starboard fin tab adjacent to a port fin tab, each of the independent fin tabs hingeably attached to the aft section of the hull, at the transom. Each fin tab includes at least one extending fin. Fin tabs are selectively deployable and retractable into and out of the water surface to redirect a wake generated by the vessel from one side to the other. A novel underwater exhaust system redirects exhaust depending on speed of the vessel and complements the wake control system.

U.S. Pat. No. 10,137,971 discloses a trim control system automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed. If the user has not chosen to refine the aggressiveness, the controller determines the setpoint trim angle from the selected base profile. However, if the user has chosen to refine the aggressiveness, the controller determines the setpoint trim angle from a trim sub-profile, which defines a variant of the relationship between vessel speed and trim angle defined by the selected base profile. The control system positions the propulsion device at the setpoint trim angle.

U.S. Pat. No. 10,343,758 discloses a method for controlling a speed of a marine vessel that includes accelerating the marine vessel in response to a launch command. The method then includes holding the vessel speed at a desired vessel speed with a controller using feedback control. The controller phases in a derivative term of the feedback control in response to determining that the following conditions are true: (a) the vessel speed is within a given range of the desired vessel speed; and (b) an acceleration rate of the marine vessel is less than a given value.

U.S. Pat. No. 10,351,221 discloses a method for controlling a trim position of a marine propulsion device that includes receiving operator demands corresponding to propulsion system operating speeds and determining a rate of change of demand versus time between an initial and a subsequent operator demand. When the rate of change of demand exceeds a predetermined rate, the control module uses successively measured operating speeds of the propulsion system and an offset trim profile to determine setpoint trim positions for the propulsion device. As the propulsion system's measured operating speed increases from an initial to a subsequent operating speed, the control module controls a trim actuator to rotate the propulsion device to the setpoint trim positions. An operating speed at which the propulsion device begins trimming up is less according to the offset trim profile than according to a base trim profile, which is utilized when the rate of change does not exceed the predetermined rate.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of automatically controlling trim position of a marine drive with a control system on a marine vessel includes receiving a user-selected command associated with wake surfing and then controlling a trim actuator to automatically position the marine drive in a tucked position, tucked position is between a vertical trim position and a minimum running trim position. Once a vessel condition of the marine vessel reaches a first threshold vessel condition the trim actuator is controlled to trim up the marine drive to a predetermined target trim position to generate wave behind the marine vessel. The first threshold vessel condition is at least one of a threshold vessel speed, a threshold engine speed, a threshold engine load, and a threshold vessel pitch.

One embodiment of a system for automatically controlling trim position of a marine drive includes a trim actuator configured to rotate the marine drive about a trim access to position the marine drive at trim positions between a minimum running trim position and a maximum running trim position. A control system is configured to receive a user-selected command associated with wake surfing and then to control the trim actuator to position the marine drive in a tucked position, wherein the tucked position is between the vertical trim position and the minimum running trim position. The control system detects that a vessel condition has reached a first threshold vessel condition, wherein the first threshold vessel condition is at least one of a threshold vessel speed, a threshold engine speed, a threshold engine load, and a threshold vessel pitch. After the marine vessel reaches a first threshold vessel position, the trim actuator is controlled to trim up the marine drive to a predetermined target trim position to generate a wave behind the marine vessel.

Various other features, objects and advantages of the invention will be made apparent from the following description taken together with the drawings.

BRIEF DESCRIPTION OF THE FIGURES

The Figure is a schematic depiction of a marine vessel incorporating one example of architecture according to the present disclosure.

DETAILED DESCRIPTION

Figure 1:
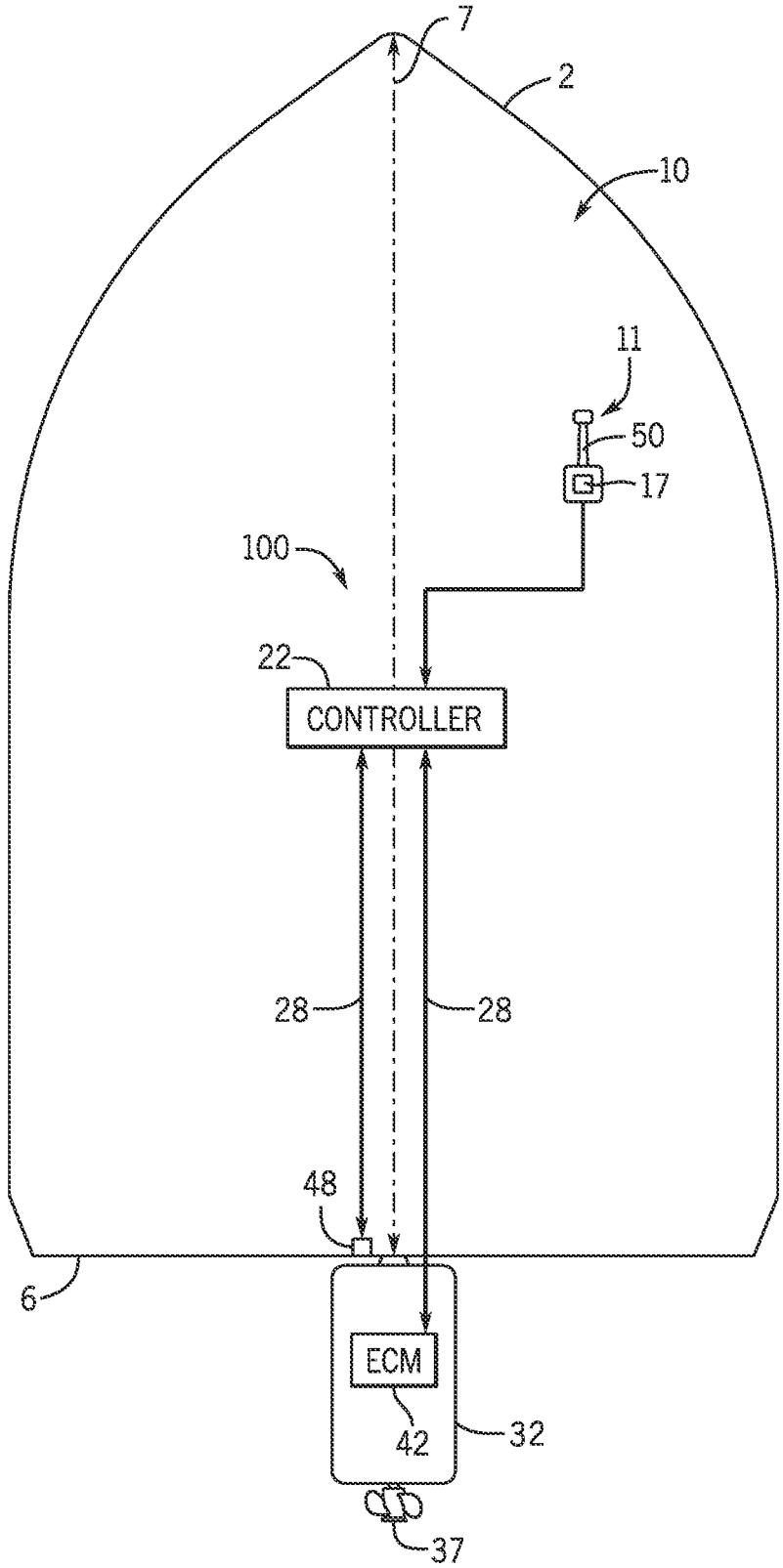
FIG. 1 depicts one embodiment of a trimmable propulsion system and trim control system on a marine vessel.

The present inventors have recognized that problems exist with respect to available propulsion control systems for wake surfing, and particularly systems with automatic propulsion and trim control that are implemented for wake surfing. In wake surfing, drives are often trimmed all the way up, to a maximum running trim position or close thereto, in order to generate a better wave for the wake surfer. The problem recognized by the inventors is that during launch and initial acceleration when the drive is trimmed up (sometimes referred to as trimmed out), the surfer gets sprayed by water from the propeller. The amount of water sprayed from the propeller is significant and can be uncomfortable for the surfer and may even cause them to fall. This is undesirable and led the inventors to develop an improved launch control system that involves trimming the marine drive down to launch the vessel, such as to a full tuck position, and then to trim the drive out to a predetermined target trim position upon reaching a threshold vessel condition.

The threshold vessel condition may be any one or more of a threshold vessel speed, a threshold engine speed, a threshold load, and a threshold vessel pitch. The threshold vessel condition is calibrated to prevent water from hitting the surfer. This provides a better experience for the surfer. Furthermore, the inventors have recognized that this also provides better operating and handling conditions for the vessel during launch because tucking the drive enables the vessel to get up to the speed setpoint for wake surfing more quickly and smoothly, and the trim control routines described herein provide improve trim control timing where the drive can trimmed up to an optimal trim position at an optimal time based on vessel condition(s) to provide an improved wake surfing experience for the surfer and for the driver.

For example, the disclosed trim control routine for wake surfing may be engaged upon receiving a user-selected command associated with wake surfing, such as a target speed setpoint associated with wake surfing and/or user engagement of a launch control mode wherein vessel propulsion is automatically controlled to bring the marine vessel up to a speed setpoint and/or to maintain the marine vessel at the speed setpoint to provide a steady speed for the wake surfer or other tow sport participant. For example, the control system may be configured to engage the disclosed trim control algorithm for wake surfing when the launch control mode is selected and the target speed setpoint is between 9 and 12 miles per hour, which is the common and recommended speed range for wake surfing. The trim actuator is then controlled to position the marine drive in a tucked position, such as at the minimum running trim position, to prepare for launch. Once a launch instruction is received, the controller monitors the specified vessel condition—such as vessel speed, engine speed, engine load, and/or vessel pitch—to determine when a first threshold vessel condition is met. Again, the first threshold vessel condition may be calibrated to avoid discomfort for the surfer such that the surfer will not be sprayed by water coming from the propeller once the vessel reaches the first threshold. Trimming the marine drive will affect a direction of thrust of a propeller with respect to a vessel transom, as well as affect the performance and consistency of thrust control during launch. Accordingly, the disclosed automatic trim routine enhances the operation of the marine vessel for the driver and passengers and provides a better experience for the wake surfer.

The drive may be maintained in the tucked position until after the first threshold vessel condition is reached, at which point the marine drive is trimmed out to a predetermined target position so as to generate a wave behind the marine vessel that is suitable for wake surfing. In certain embodiments, the system may be configured to maintain the drive at the predetermined target position, which may be a trimmed out position between the vertical trim position and a maximum running trim position, until a second threshold vessel condition is reached that indicates that the passenger is no longer wake surfing behind the vessel, such as a second threshold vessel speed, second threshold engine speed, second threshold load, or second threshold tilt. In certain embodiments, the second threshold vessel condition is less than or equal to the first threshold vessel condition.

FIG. 1 illustrates a marine vessel 2 having a propulsion system 10 for controlling propulsion and trim in accordance with the present disclosure. The propulsion system 10 includes at least one marine drive 32, and in some embodiments may include a plurality of marine drives configured and controlled as described herein. In the depicted embodiments, the marine drive 32 is an outboard motor coupled to the transom 6 of the marine vessel 2. The marine drive 32 is attached to the marine vessel 2 in a conventional manner such that each is rotatable about a respective vertical steering axis in order to steer the marine vessel 2 and is rotatable about a horizontal trim axis in order to trim the drives up and down. In the examples shown and described, the marine drive 32 is an outboard motor; however, the concepts of the present disclosure are not limited for use with outboard motors and can be implemented with other types of trimmable marine drives, such as stern drives.

The marine drives may comprise an engine 33 that causes rotation of the drive shaft to thereby cause rotation of a propeller shaft having a propeller 37 at the end thereof, which will be understood as referring to a propeller or an impeller, or combination thereof. A person of ordinary skill in the art will understand in view of the present disclosure that alternatively the marine drives may comprise an electric motor that causes rotation of the drive shaft to thereby rotate the propeller 37. The propeller 37 is connected to and rotates with the propeller shaft to propel the marine vessel 2. The direction of rotation of the propeller 37 is changeable by a gear system (e.g., a transmission), which has a forward gear associated with a forward thrust caused by first rotational direction and a reverse gear associated with a backward thrust caused by the opposite rotational direction. As is conventional, the gear system (e.g., a transmission) is positionable between the forward gear, a neutral state (no thrust output), and the reverse gear. Such positioning is typically controlled by a remote control 11 associated with the respective marine drive 32. As is conventional, the remote control 11 includes a lever 50 movable by an operator into a reverse position at causes the gear system to shift into reverse gear, a neutral position that causes the gear system to shift into a neutral state, and a forward position that causes the gear system to shift into forward gear. The remote control lever 50 is also movable by an operator to provide throttle control, and thus thrust control, within the respective gear position. In a preferred embodiment, the remote control 11 is a drive-by-wire input device, and the position of the lever 50 sensed by the position sensor 17 will be translated into a control input to a throttle valve, for example. Such drive-by-wire systems are known in the art, an example of which is disclosed at U.S. Pat. No. 9,103,287 incorporated herein by reference in its entirety.

Those skilled in the art of marine vessel propulsion and control are familiar with many different ways in which the trim angle of a marine drive, such as an outboard motor or stern drive, can be varied to change the handling or fuel efficiency of the vessel. For example, many manual trim control systems are known to those skilled in the art. In typical operation, the operator of a marine vessel can manually change the trim angle of an associated marine drive as the velocity of the vessel changes. This is done to maintain an appropriate angle of the vessel with respect to the water as it achieves a planing speed and as it increases its velocity over the water while on plane. The operator inputs a command (e.g., via trim control buttons 13 or other trim control inputs, see FIG. 7) to change the trim angle for example by using a keypad, button, or similar input device with "trim up" and "trim down" input choices.

The systems of the present disclosure are also capable of carrying out automatic trim control (auto-trim) methods, in which the marine drive is automatically trimmed up or down depending on a desired effect and/or based on one or more vessel conditions. Auto-trim systems perform trim operations automatically, as a function of measured vessel conditions, without requiring intervention by the operator of the marine vessel. As described herein, the inventors have recognized that an automatic trim program, or routine, can be devised and implemented to provide improved launch control during vessel launch for when engaging in wake surfing. Namely, the marine drive 32 can be trimmed based on vessel speed and/or other vessel conditions to optimize trim for wake surfing, including trimming the drive 32 all the way down to initiate launch and then trimming the drive out once the drive is at or near its speed setpoint for wake surfing The trim position of the marine drive 32 is actuated by a respective trim actuator 16 configured to rotate the marine drive 32 about a horizontal trim axis. In one example, the trim actuator 16 is a hydraulic piston-cylinder assembly in fluid communication with a hydraulic pump-motor combination, although the principles of some of the below examples could apply equally to electric linear actuators, pneumatic actuators, or other types of trim devices. The trim actuator may be actuated between an extended position and a retracted position by provision of hydraulic fluid, electrical power, pneumatic fluid, etc. The extension and retraction of the trim actuator can be used to rotate a trimmable marine drive up and down with respect to a marine vessel to which it is coupled.

The trimming operation of each trim actuator 16 is controlled by controller system 100, such as by the central controller 22. The controller 22, is communicatively connected to each the trim actuator 16 to control activation thereof, such as based on engine speed or vessel speed. In the depicted embodiment, the controller 22 may receive engine speed, or engine RPM, from the ECM 42. The engine speed may be sensed by the engine or motor rotational speed sensor 51, as is well known in the relevant art. The controller 22 may receive a vessel speed from vessel speed sensor 14.

Figure 2:
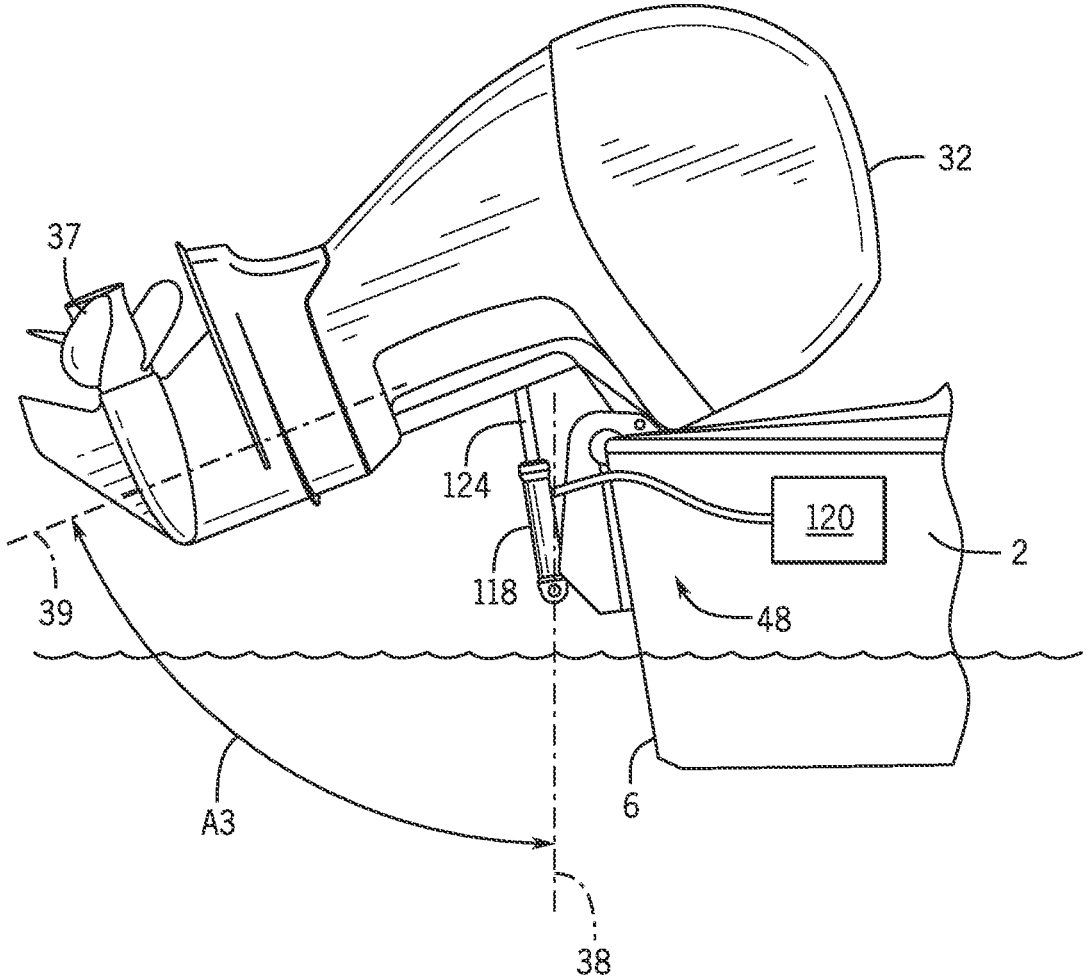
FIG. 2 is a side view of a marine vessel having a marine drive and trim actuator, where the drive is in fully trimmed up position out of the water, such as for trailering.

Referring to FIG. 2, the position of a trimmable marine drive 32 (such as the outboard motor shown herein) with respect to the transom 6 is controlled by a trim actuator 48. The trim actuator 48 includes a hydraulic piston-cylinder assembly 118 connected to a hydraulic pump-motor combination 120. The piston-cylinder assembly 18 has a first end (here, the cylinder end) coupled to the transom 9 of the vessel 2 and a second, opposite end (here, the rod end) coupled to the marine drive 32, as known to those having ordinary skill in the art. The piston-cylinder assembly 18 operates to rotate the marine drive 32 about a horizontal trim axis to a trimmed up position, to a trimmed down position, or to maintain the marine drive 32 in any position therebetween as the pump-motor combination 120 provides hydraulic fluid to the piston-cylinder assembly 18 to move the piston within the cylinder. Other types of hydro-mechanical or electro-mechanical actuators could be used in other examples.

Figure 3:
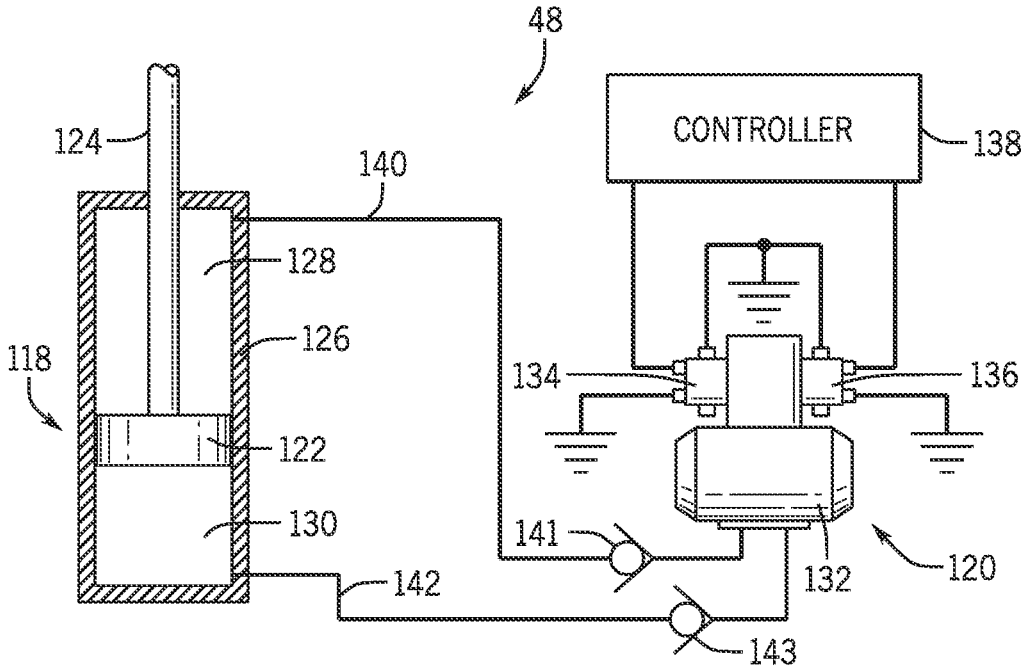
FIG. 3 depicts one embodiment of a trim actuator in a system for controlling trim position of marine drives.

One example of a hydraulic trim actuator 16 is illustrated at FIG. 3. The piston-cylinder assembly 118 is shown schematically as having a piston 122 connected to a rod 124 disposed in a cylinder 126. The piston 122 defines a first chamber 128 within the cylinder 126 and a second chamber 130 within the cylinder 126, both of which chambers 128, 130 change in size as the piston 122 moves within the cylinder 126. The pump-motor combination 120 includes a pump-motor 132 connected to a trim-in (or trim-down) relay 134 and a trim-out (or trim-up) relay 136. In other examples, the trim-in relay 134 and the trim-out relay 136 are a single relay that can turn the pump-motor 132 on or off and can effectuate a trim down or trim up movement of the trim actuator 16. The relays 134 and 136 are connected to a controller 138 that controls energizing of solenoids in the relays 134 and 136, which act as switches to couple a power source such as a battery (not shown) to chamber 128 of the piston-cylinder assembly 118, and a second hydraulic line 142 couples the pump-motor 132 to the second chamber 130 of the piston-cylinder assembly 118. The controller 138 may be communicatively connected to the controller 22 to receive a desired trim position or trim control action. As long as the trim down relay 134 is activated, the pump-motor 132 provides hydraulic fluid through the first hydraulic line 40 to the first chamber 128 of the piston-cylinder assembly 18, thereby pushing the piston 122 downwardly within the cylinder 126 and lowering (trimming in or trimming down) the marine drive 32 coupled to the rod 124. As long as the trim up relay 136 is activated, the pump-motor 132 provides hydraulic fluid through the second hydraulic line 142 to the second chamber 130 of the piston-cylinder assembly 118, thereby pushing the piston 122 upwardly within the cylinder 126 and raising (trimming out, or trimming up) the marine drive 32 coupled to the rod 124. Hydraulic fluid can be removed from the opposite chamber 128 or 130 of the cylinder 126 into which fluid is not being pumped in either instance and drained to a tank or circulated through the pump-motor 132.

In this way, the trim actuator 16 can position the marine drive 32 at different angles with respect to the transom 9. FIGS. 2 and 4-6 demonstrate exemplary trim positions demonstrating a full range of trim. In each of FIGS. 2 and 4-6 the trim position of the marine drive 32 is shown with respect to a dashed line representing a vertical axis 38. Additionally, another dashed line in each of the figures represents a longitudinal axis 39 through the marine drive 32. The angle between the vertical axis 38 and the longitudinal axis 39 is the trim angle A. In FIG. 2, the marine drive 32 is trimmed up and is lifted out of the water to trim angle A3. Preferably, non-running marine drives are placed in this position (or a highest possible trimmed up position), such as for trailering or on multi-drive vessels where one or more of the drives is not being operated while the vessel is underway.

Figure 4:
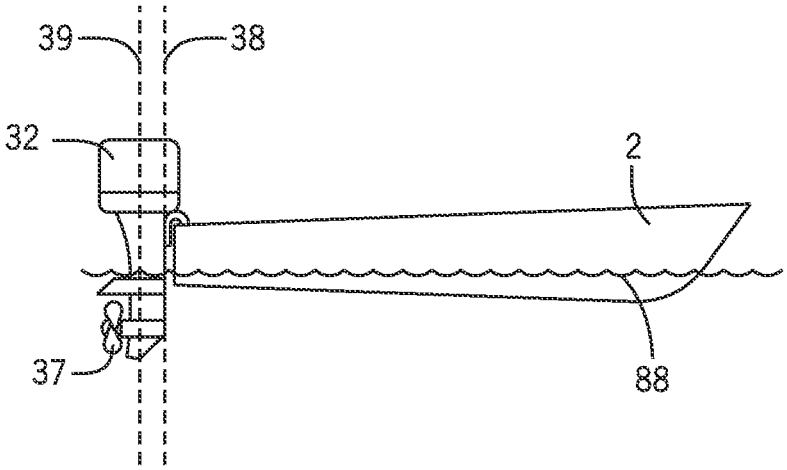
FIG. 4 is a side view of a marine vessel having a marine drive in a vertical trim position.
Figure 5:
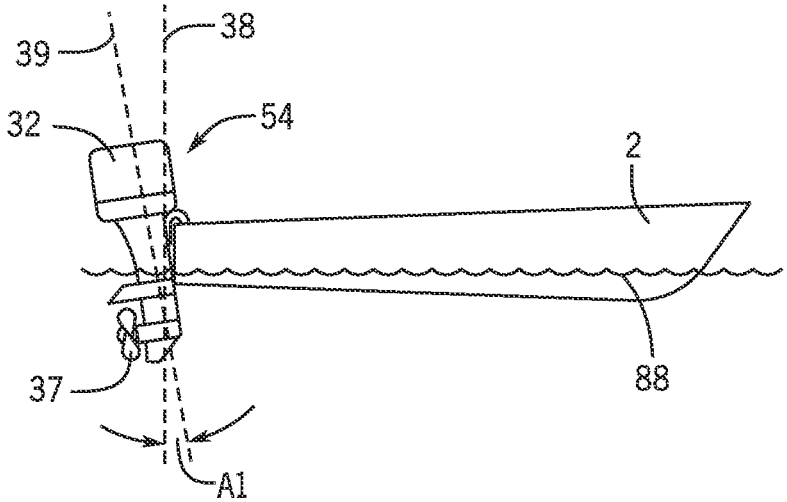
FIG. 5 is a side view of a marine vessel having a marine drive in an exemplary minimum running trim position where the drive is fully trimmed down.
Figure 6:
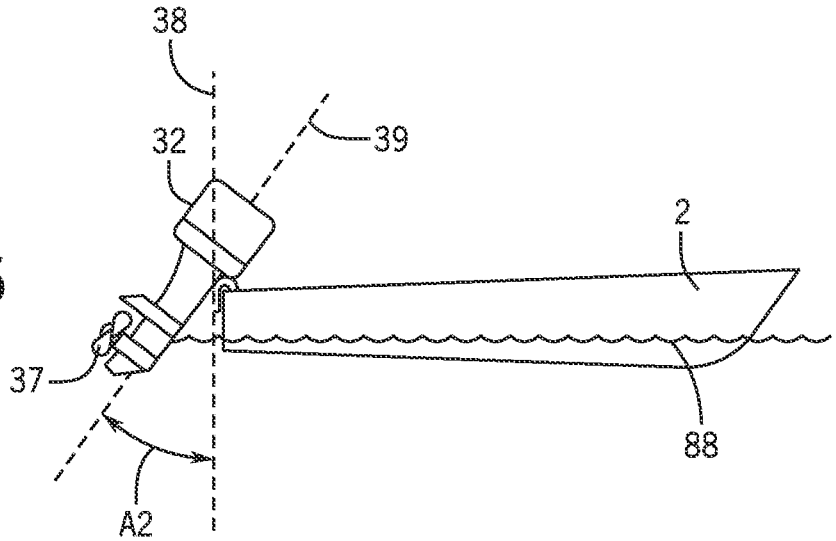
FIG. 6 is a side view of a marine vessel having a marine drive in an exemplary maximum running trim position wherein the drive is trimmed up.

FIGS. 4-6 represent various running trim positions, which include trim positions available to the trim control system 100 while the drive 32 is running and the vessel is underway. This range of trim position available when a drive is running and the vessel is underway is referred to herein as the range of running trim positions between a minimum running trim position and a maximum running trim position. In FIG. 4, the marine drive 32 is in a vertical trim position, or neutral trim position, in which the vertical axis 38 and the longitudinal axis 39 are generally parallel to one another.

In FIG. 5, the marine drive 32 is trimmed all the way down (or fully trimmed in) such that a propeller 37 of the marine drive 32 is closer to the hull of the marine vessel 2 than when the marine drive 32 is in the neutral trim position. This position is referred to herein as a minimum running trim position, wherein its longitudinal axis 39 is oriented at an angle A1 with respect to the vertical axis 38. This position is sometimes referred to as "full tuck" and is often the preferred trim position for launch, when the vessel is initially accelerating from idle or very low speed. The minimum running trim position is just one example of a tucked position that may be implemented at launch, and in various embodiments the system 100 may be configured to place the marine drive 32 in any tucked position between the vertical trim position shown in FIG. 4 and the minimum running trim position shown in FIG. 5.

In the trim control method described herein, this tucked position is automatically implemented by the trim control system 100 at the start of the trim control method, where the marine drive 32 is positioned in the minimum running trim position shown as angle A1 at the time of initial acceleration. This provides better control during launch, enables the vessel to get up to speed more quickly, and avoids spraying the surfer during launch, among other benefits. In certain embodiments, the propulsion device is maintained in the minimum running trim position until it reaches a threshold speed. After reaching the threshold speed or other threshold vessel condition, the drive is automatically trimmed up to a predefined position for generating or maximizing a surfing wake.

In FIG. 6 the marine drive 32 is trimmed up (sometimes referred to as trimmed out) such that the propeller 37 is further from the hull. Here, the propeller 37 of the drive 32 is at or near the water surface 88. The longitudinal axis 39 extends at an angle A2 with respect to the vertical axis 38. For trim positions above, or greater than, that point, the propeller may be out of the water, particularly if the vessel is sitting at dock or idling. This exemplifies one embodiment of a maximum running trim position. To provide just one illustrative example, the maximum running trim angle A2 may be around 20 degrees of trim as measured from vertical. To provide further illustration, the maximum running trim angle may be between 10 degrees and 30 degrees up from vertical, but vessel configurations vary widely and thus the maximum running trim angle may be greater or less depending on the vessel configuration, drive configuration, etc.

Trimmed out positions greater than the neutral position of FIG. 4 will cause the bow of the marine vessel 2 to rise out of the water and the stern to drop down. This is used (often in conjunction with trim tabs or other trim devices designed for wake surfing) to generate a wave behind the vessel for purposes of wake surfing. Wake surfing and exemplary systems for implementing wake surfing are known, such as described in U.S. Pat. No. 9,937,984 incorporated herein.

FIG. 2 is a closer depiction of the drive 32 trimmed up even further, which as described above may represent a trim position where the marine drive 32 is fully trimmed up and is lifted out of the water. In certain embodiments, this is not within the range of available running trim positions. As an example, the controller 22 may define the running trim position as an angle or a percentage between the fully trimmed down minimum running trim position (full tuck) and the fully trimmed up maximum running trim position. In various embodiments, the trim position may be expressed as an angle, a percentage of a total allowable angle (e.g., total running trim angle between A1 and A2) to which the marine drive 32 can be trimmed, a scalar value, a polar coordinate, or any other appropriate unit. For purposes of the description provided hereinbelow, the angle will be expressed as a position, or trim angle between A1 and A2, and alternatively may be described herein as a percentage of allowed (or running) trim measured from A1 being 0% (minimum running trim) to A2 being 100% (maximum running trim). As will be understood by a person having ordinary skill in the art, trim can be defined and expressed variously, such as an angle or percentage measured from vertical, from a fully trimmed up position, or from a fully trimmed down position. The trim position is measured by the trim position sensor 36.

Figure 7:
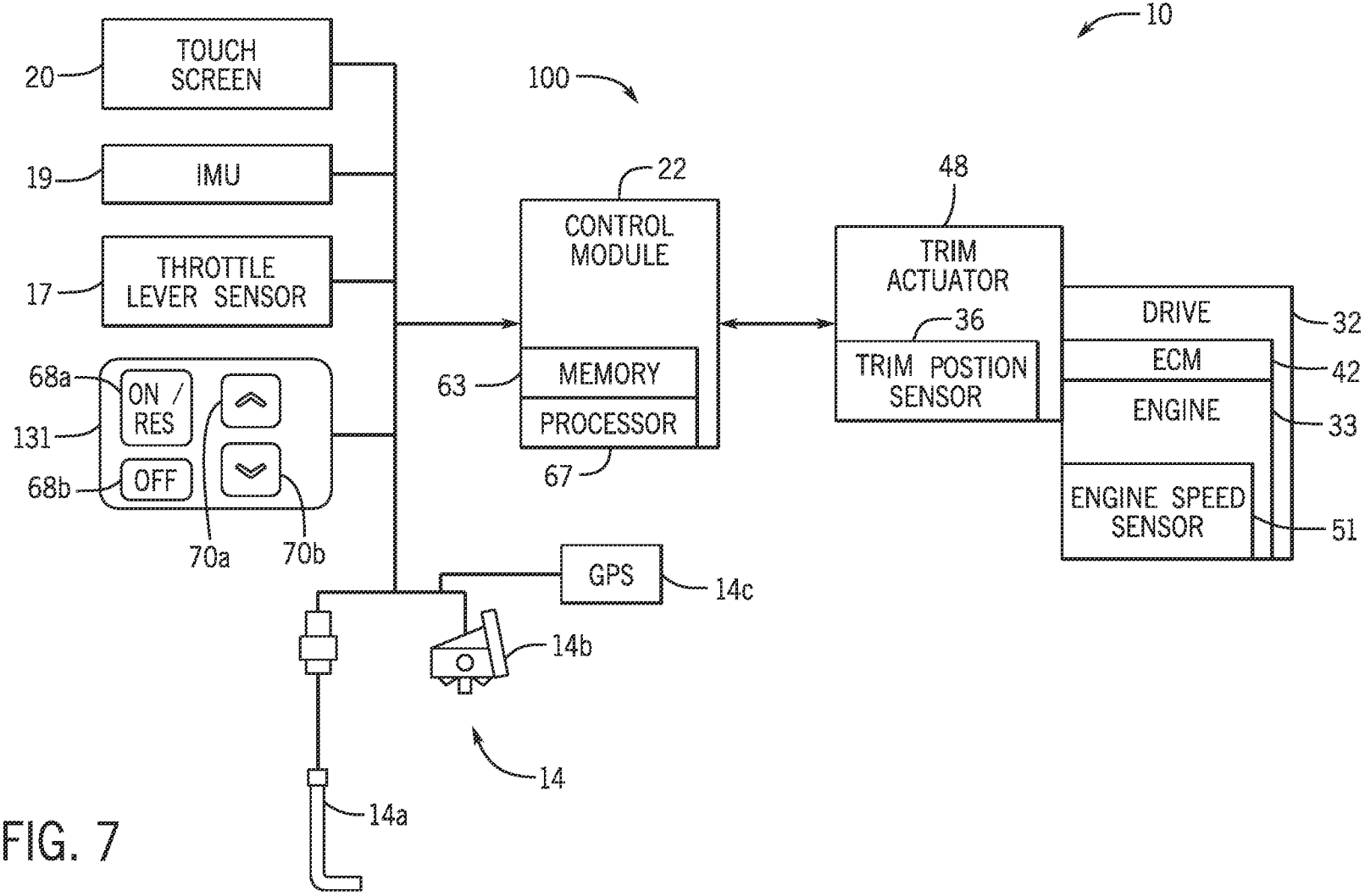
FIG. 7 is a schematic exemplifying one embodiment of a marine propulsion system and trim control system according to one embodiment of the present disclosure.

Referring to FIGS. 1 and 7, the propulsion system 10 includes a control system 100 that includes one or more controllers and communication networks for effectuating trim control as described herein and may also be configured for effectuating propulsion control. Referring to FIG. 1, each marine drive 32 may be associated with and controlled by an engine control module (ECM) 42 and a central controller 22, such as a helm control module (HCM) or command control module (CCM) communicatively connected to the ECM 42. The connection between the HCM 22 and the ECM 42 is via a communication link 28, which in may be by any known means and in various embodiments could be a CAN bus for the marine vessel (such as a CAN Kingdom network), a dedicated communication bus between the respective control modules 22 and 42, a wireless communication network via Bluetooth, BLE, ZigBee, or any other wireless protocol, or via other communication means implemented for facilitating communication between electronic devices on a marine vessel.

Thereby, communication is facilitated between the controllers in the control system 100, whereby the ECM communicates communicate engine parameters—e.g., engine state (stall, crank, or run), engine rpm, throttle position, transmission speed, etc.—and the HCM 22 (or other central controller) can communicate control instructions—e.g. output commands based (such as based on user inputs to control throttle, steering, and/or trim) and/or output restrictions. The HCM 22 may further be configured to carry out trim and speed control methods, such as automatic trim control and/or automatic vessel speed control, and including the methods described herein. The control system 100 arrangement depicted and described at FIGS. 1 and 7 is merely representative and various other arrangements are known and within the scope of the disclosure. For example, the control system 100 may further include additional or different controllers and/or controller types than those depicted, such as a powertrain control module (PCM) and/or a thrust vector module (TVM), as are well-known in the art. The methods described herein may be accomplished by any one controller or by cooperation of two more controllers within the control system 100 on the vessel 2.

Each of the controllers (HCMs, ECMs, etc.) may have a memory and a programmable processor, such as processor 67 and memory 63 in HCM 22. As is conventional, the processor 67 can be communicatively connected to a computer readable medium that includes volatile or nonvolatile memory upon which computer readable code (software) is stored. The processor 67 can access the computer readable code on the computer readable medium, and upon executing the code can send signals to carry out functions according to the methods described hereinbelow. Execution of the code allows the control system 100 to control one or more trim actuators 48 and various other systems in or associated with each marine drive 32. Processor 67 can be implemented within a single device but can also be distributed across multiple processing devices or sub-systems that cooperate in executing program instructions. Examples include general purpose central processing units, application-specific processors, and logic devices, as well as any other type of processing device, combinations of processing devices, and/or variations thereof. The control system 100 may also obtain data from sensors aboard the vessel (e.g., trim position sensors 36. In the example shown, at least one HCM 22 comprises a memory 63 (such as, for example, RAM or ROM), although all of the control modules may comprise such storage.

The control system 100 may receive input from a throttle lever sensor 17 indicating throttle lever 50 position of the remote control 11, vessel speed sensor 14, display 20, trim input 13 (e.g., trim control buttons) (collectively, the user input devices) communicatively connected (e.g. via CAN bus 28) to one or more controllers 22. In the Examples shown in FIGS. 1 and 7, the HCM 22 interprets these signals and sends commands to the trim actuators 48*a* and 48*b*, the marine drives 31, 32, etc. Trim control input 13 may be configured to receive user inputs to adjust trim position of the marine drive 32 and preferably the trim control input 13 is configured such that the user separately controls the trim position of each drive. The vessel speed sensor 14 may be, for example, a pitot tube sensor 14*a*, a paddle wheel sensor 14*b*, or any other speed sensor appropriate for sensing the actual speed of the marine vessel. Alternatively or additionally, the vessel speed sensor may be a GPS device 14*c* that calculates vessel speed by determining how far the vessel has traveled in a given amount of time. The touch screen display 20 may comprise part of a user interface system at the vessel helm. In one embodiment, the display 20 may comprise part of an on-board management system for the marine vessel 2, such as a VesselView® by Mercury Marine of Fond Du Lac, Wis. In various embodiments, the display 20 may be a touch screen configured to facilitate user inputs, and/or the display 20 may be incorporated in a user interface system that further includes one or more input devices for facilitating user input, such as a keyboard, push buttons, etc.

The controller 22 may also receive inputs from an inertial measurement unit (IMU) 19 that senses a roll position, yaw position, and pitch of the vessel 2. For example, the IMU 19 may comprise a gyroscope, such as a three-axis gyroscope, to detect orientation information that may be used to determine the roll, yaw, and pitch angles of the marine vessel 2. In other embodiments, the IMU 19 may be a magnetometer, or may include any other type of position or inertial measurement unit, such as a combination accelerometer and/or gyroscope with a magnetometer.

The touchscreen 20 or the trim input keypad 13 can be used to receive user-selected trim commands, including to initiate or exit any number of trim control or operation modes. This includes user-selection of a launch control mode wherein trim and/or propulsion output are automatically controlled. Such launch control modes are known for various tow sporting applications. Exemplary launch control methods and modes of operation are described at U.S. Pat. Nos. 6,485,341, 7,214,110, 7,361,067, 10,343,758, which are incorporated herein by reference in their entireties. As is typical, the user may select launch control mode and may then make a subselection designating a particular launch behavior, such as to select a stored launch profile. Here, the system 100 may be configured such that a "wake surfing" launch profile or mode is available. Alternatively, the user may select the launch control mode and then may set a target speed to be automatically maintained by the system 100. As is known, wake surfing is typically conducted at vessel speeds between 8 and 15 mph, and more often between about 9 or 9.5 mph and 12 mph. Thus, where a target speed associated with wake surfing is selected, such as between 8 and 15 mph, or in certain embodiments between 9 or 9.5 mph and 12 mph, the system 100 may be configured to interpret the user-selected command (i.e., the target speed selection and engagement of the launch control mode) as a user-selected command associated with wake surfing.

In certain embodiments the trim control input 13 may be a keypad with buttons 70*a* and 70*b* configured to manually trim up the propulsion device 32 up or down, respectively, such as to modify the trim position automatically effectuated by the control methods described herein. Button 68*a* may be configured to start or resume the auto-trim functionality described herein, and button 68*b* can exit the auto-trim routines described herein. The touchscreen 62 can also display operational characteristics to the operator of the vessel and can allow the operator to access propulsion system modes, such as to engage the launch control mode and/or to set a target speed setpoint appropriate for wake boarding. Once these modes and functionalities are engaged, the system 100 will automatically control trim position of the marine drive to optimize trim for wake boarding as described herein.

Figure 8:
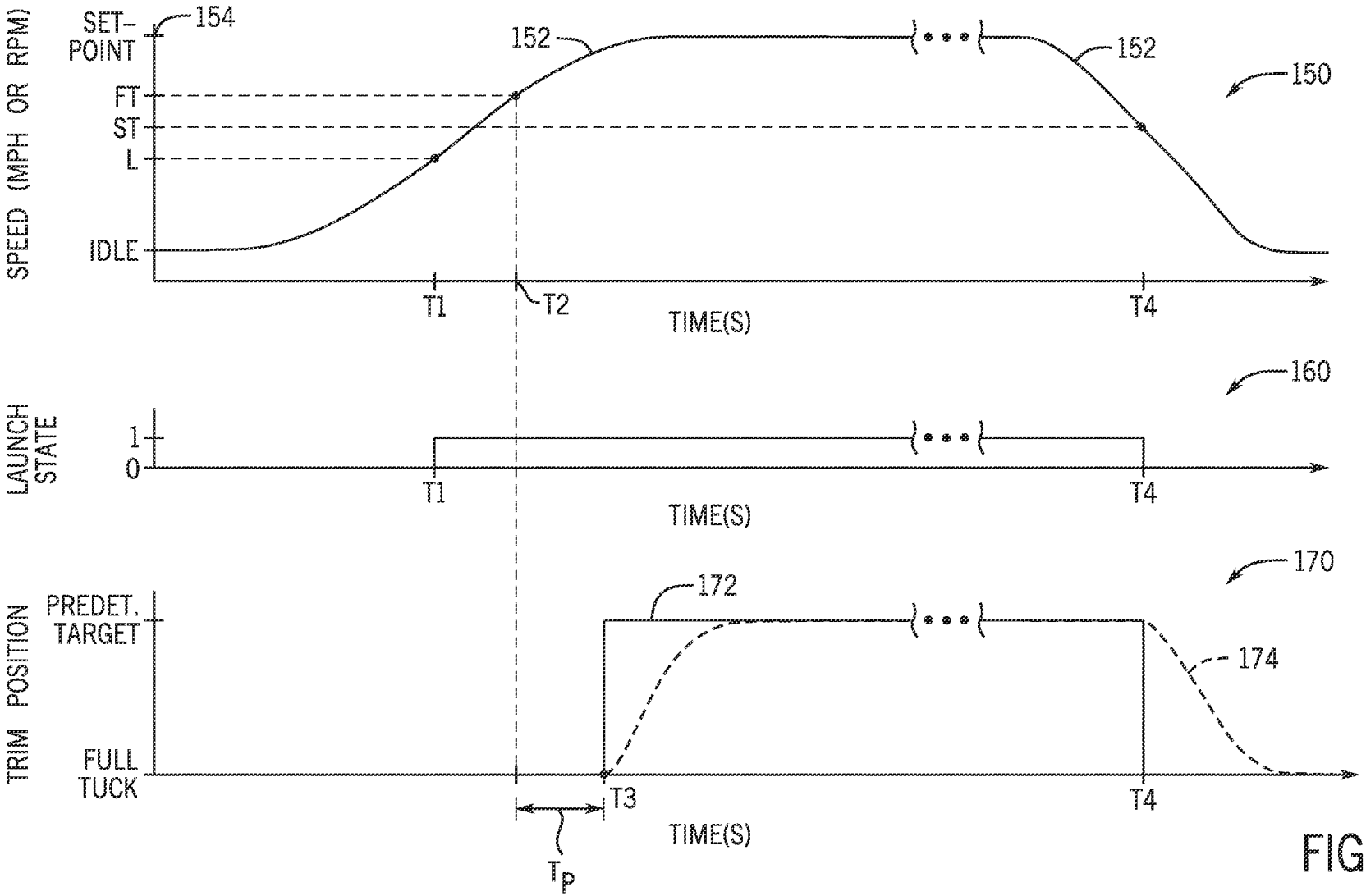
FIG. 8 is a graph representing an automatic trim control method and function for wake surfing according to one embodiment of the present disclosure.
Figure 9:
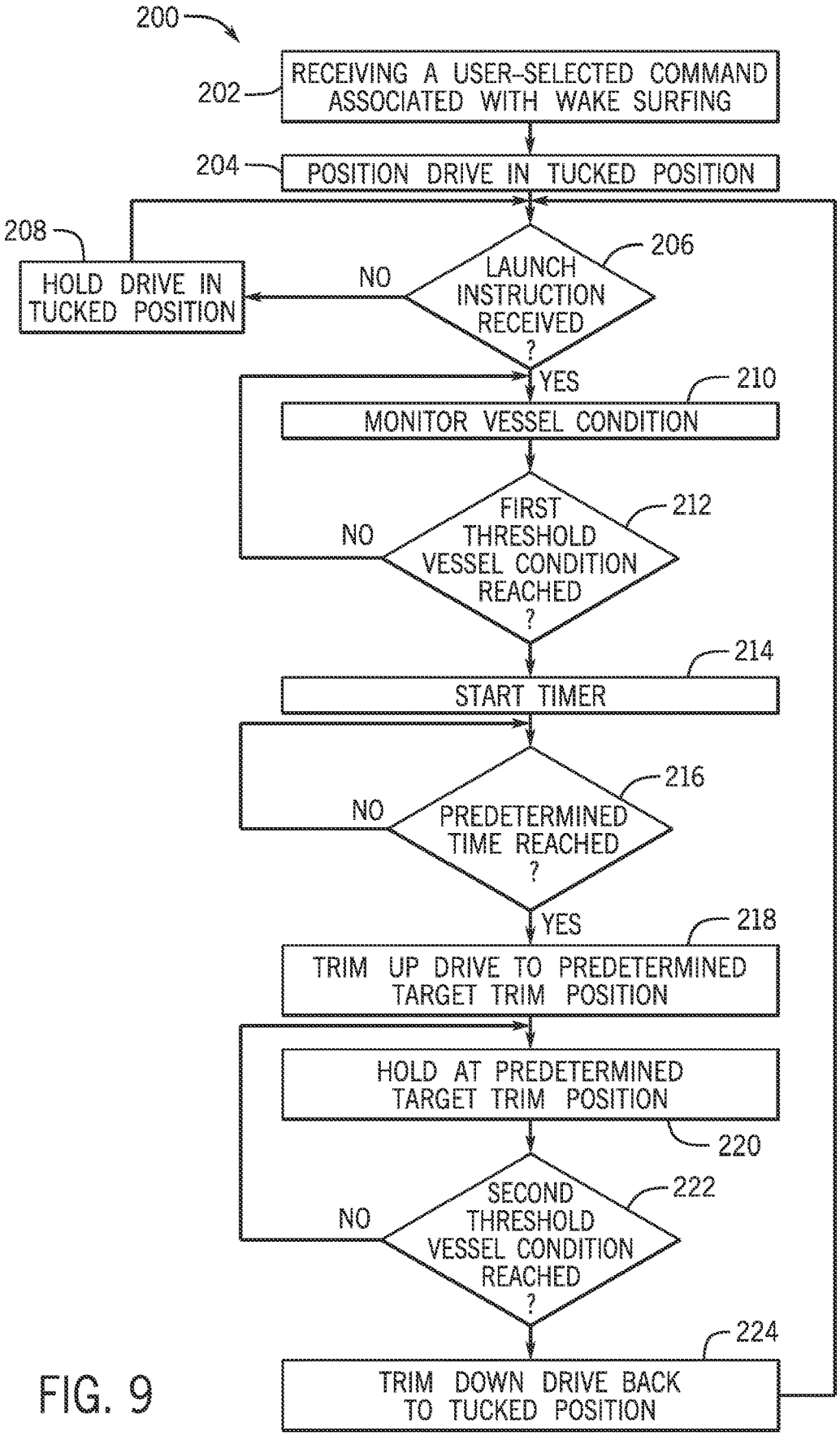
FIG. 9 is a flow chart depicting an exemplary method for automatically controlling trim according to one embodiment of the present disclosure.

FIGS. 8 and 9 exemplify methods 200 of automatically controlling trim position of a marine drive 32 by the control system 100 based on speed, which in various embodiments could be vessel speed or engine speed. Similar embodiments may be carried out based on engine load and/or based on vessel pitch. In FIG. 8, three graphs are depicted with respect to a common time axis. The top graph 150 shows a speed condition of the marine vessel with respect to time, indicated at line 152, such as vessel speed or engine RPM. Graph 160 shows a launch state within the controller with respect to time. Graph 170 shows trim position with respect to time, including a target trim position shown at line 172 determined by the controller 22 and an actual trim position of the drive 32 shown at line 174. The system 100 behaves as illustrated in order to effectuate optimized trim control for wake surfing. As the marine vessel speeds up from idle, it reaches a first threshold speed L associated with launch. Once the launch threshold speed is reached at time T1, the controller recognizes that launch is occurring and changes the launch state from zero to one. This triggers the wake surfing launch routine. The controller continues to monitor the speed condition as the speed increases toward the target speed setpoint. Once the first threshold FT speed condition is reached at time T2, the drive 32 will be trimmed out to create or optimize the wave behind the boat. In the depicted embodiment, the first threshold speed FT is less than the target speed setpoint. For example, where the target speed setpoint is between 9 and 12 mph, the first threshold speed may be between 7 and 9 mph. In other embodiments, various thresholds and/or the target speed setpoint may be based on engine speed or engine load and would values calibrated appropriately for wake surfing.

Graph 170 depicts the trim position. In one embodiment, the system 100 is configured to trim up the marine drive to the predetermined target trim position after expiration of a predetermined time following the marine vessel reaching the first threshold vessel condition. In one embodiment, a timer is started at time T2 once the first threshold vessel condition is reached FT. The timer expires after the predetermined time Tp, which in the example is at time T3. For instance, the predetermined time Tp may be a time between zero seconds and 10 seconds, such as 2 seconds or 3 seconds. In one embodiment, the predetermined time Tp may be a configurable value configurable to accommodate various vessel and propulsion system configurations and may be configured to account for an expected amount of time for the vessel to get up to speed following the launch threshold L.

The target trim position held by the controller is represented at line 172. The target trim position is maintained at the tucked position, such as full tuck, until time T3. At time T3 the target trim position is adjusted to be the predetermined target trim position most appropriate for generating a wave for wake boarding behind the marine vessel. In some embodiments, the predetermined target trim position may be a configurable value to optimize wake surfing behind a particular vessel. Alternatively or additionally, the predetermined target trim position may be configurable or selectable by a user, such as part of selecting a launch profile or launch control values. In certain embodiments, the predetermined target trim position is a calibrated or user-selected trim position between the vertical trim position and a maximum running trim position such that the drive is trimmed up to optimize the wave.

In certain examples, the predetermined target trim position may be at or near the maximum running trim position, such as between 50% and 100% trim between the minimum running trim position and the maximum running trim position. In other embodiments, the predetermined target trim position may be between 10% and 50% of the maximum trim. In one example, the system 100 may be configured with a preset number of selectable target trim positions, such as predetermined target trim positions ranging from 10% to 50% (e.g., 10%, 20%, 30%, 40%, 50%), or ranging from 10% to 100% (e.g., 10%, 25%, 50%, 75%, 100%). The target trim positions may be selectable by a user, such as via the trim control interface 13. Once the target trim position is selected, the system will effectuate that target based on the vessel condition, as described herein. In one embodiment, if the predetermined target trim position is changed by the user while surfing is underway, such as while the drive is at a first predetermined target trim position and a second selectable predetermined target trim position is selected by a user, the system 100 may be configured to adjust the trim to the second, selected predetermined target trim position.

The actual trim position is represented at line 174, such as measured by the trim position sensor 36. The actual trim position takes time to reach the target value, and thus trails the target value when the target value changes. The trim position is held at the predetermined target trim position as long as the marine vessel is maintained at the target speed setpoint, which is presumably while the surfer is engaged in wake surfing. When the speed condition decreases past, or below, a second threshold speed condition ST, which is an exemplary second threshold vessel condition, then the trim position returned to the tucked position. Thus, once the speed condition passes the second threshold ST at time T4, the target trim position returns to the tucked position. The actual trim position represented at line 174 follows the target. In the example, the second threshold vessel condition ST is less than the first threshold vessel condition FT. In some embodiments, the controller 22 may be configured to effectuate hysteresis trim control based on a filtered trim position measurement, such as to prevent toggling or inconsistent trim system behavior.

Alternatively or additionally, the system 100 may be configured to control trim based on vessel pitch, such as measured by the IMU 19. In such an embodiment, the drive 32 may be moved from the tucked position to the predetermined target when the vessel pitch reaches a threshold vessel pitch. The vessel pitch will increase during launch, where the bow of the boat will rise as the vessel accelerates. The system 100 may be configured to monitor vessel pitch output from the IMU 19 and to trim up the marine drive 32 to the target trim position once the vessel reaches a threshold vessel pitch. To provide just one example, where a marine vessel pitch is around 2 degrees or 3 degrees from horizontal when the vessel is stationary, the threshold vessel pitch for purposes of the disclosed launch control method and system may be between 10 degrees and 15 degrees from horizontal. In certain embodiments, the threshold vessel pitch may be configurable by a user to suit user preferences, the operating conditions of the vessel, etc.

One embodiment of a method 200 of automatically controlling trim position of a marine drive is depicted at FIG. 9. A user-selected command associated with wake surfing is received at step 202. For example, the user-selected wake surfing command may include a target speed setpoint associated with wake surfing, such as a target speed setpoint being a vessel speed between 8 and 15, or in some embodiments between 9 and 12 miles per hour, or a correlated engine speed or engine load. Alternatively or additionally, the user-selected command associate with wake surfing may include selection of launch control mode by a user to engage automatic propulsion control during launch, which may be a launch control mode specific to wake surfing. After receiving the wake surfing command, the control system 100 is configured to position the marine drive 32 in a tucked position at step 204. For example, the tucked position may be between the vertical trim position and the minimum running trim position available for the particular drive 32. In one example, the tucked position is a full tuck where the drive is in the minimum running trim position.

The drive 32 is held in the tucked position at step 208 until a launch instruction is received, represented at step 206. Once the launch instruction is received, the control system 100 monitors a vessel condition at step 210 to detect when the vessel condition has reached a first threshold vessel condition. The first threshold vessel condition is one of a threshold vessel speed, a threshold engine speed, a threshold engine load, and/or a threshold vessel pitch. The first threshold vessel condition is a vessel condition associated with the marine vessel being near, approaching, or at the target speed setpoint. In one embodiment, the first threshold vessel condition is a threshold vessel speed, a threshold engine speed, a threshold engine load, and/or a threshold vessel pitch that is less than the target speed setpoint for the launch control or for some other automatic propulsion control for the vessel. To provide just one example, the first threshold vessel condition may be a vessel speed in the range of 7 to 9 miles per hour, or a similar engine speed or engine load for the particular vessel. Once the first threshold vessel condition is reached at step 212, the system may be configured to start a timer at step 214. Once a predetermined time is reached at step 216, the marine drive 32 will be trimmed up to a predetermined target trim position at step 218 to generate a wave behind the marine vessel. As described above, the predetermined target trim position may be a user-selected value, such as a value selected from a predefined list of target trim position options.

In other embodiments, the first threshold vessel condition may be at or very close to the target speed setpoint. In such an embodiment, the timer may be eliminated, and the drive may be trimmed up once the threshold vessel speed or other first threshold vessel condition is met.

Once the drive reaches the predetermined target trim position, it is held at that position at step 220 to maintain the wave as long as the surfing continues. The drive may automatically be trimmed back down once the marine vessel 2 slows down below a threshold speed, or some other second threshold vessel condition. The control system 100 monitors the vessel condition to detect when the second threshold vessel condition is reached at step 222. For example, the second threshold vessel condition may be a value that is less than the first threshold vessel condition, such as a lower vessel speed, lower engine speed, or lower engine load.

Alternatively or additionally, the vessel condition may be based on vessel pitch, as described above. In such an embodiment, the second threshold vessel condition may be a pitch that is closer to horizontal than the first threshold vessel condition pitch value. Once the threshold vessel condition is reached at step 222, the control system 100 may automatically trim the drive 32 back down to the tucked position at step 224. Thus, the drive will be in an appropriate position to restart launch whenever the launch instruction is received.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of automatically controlling trim position of a marine drive on a marine vessel, the method comprising:

receiving a user-selected command to enter a launch control mode;

controlling a trim actuator to automatically position the marine drive in a tucked position, wherein the tucked position is between a vertical trim position and a minimum running trim position;

detecting that a vessel condition of the marine vessel has reached a first threshold vessel condition; and after the marine vessel reaches the first threshold vessel condition, automatically controlling the trim actuator to trim up the marine drive to a predetermined target trim position to generate a wave behind the marine vessel, wherein the predetermined target trim position is between the vertical trim position and a maximum running trim position.

2. The method of claim 1, wherein the first threshold vessel condition is at least one of a threshold vessel speed, a threshold rotational speed, a threshold load, and a threshold vessel pitch.

3. The method of claim 2, wherein the first threshold vessel condition includes the threshold rotational speed being a speed of a drive shaft causing rotation of a propeller of the marine drive.

4. The method of claim 2, wherein the first threshold vessel condition includes the threshold rotational speed being an engine RPM or a motor RPM of the marine drive.

5. The method of claim 2, wherein the first threshold vessel condition includes the threshold load being an engine load or a motor load of the marine drive.

6. The method of claim 1, wherein the first threshold vessel condition includes a threshold vessel speed between 8 and 15 mph.

7. The method of claim 1, wherein the first threshold vessel condition includes a threshold vessel pitch.

8. The method of claim 1, wherein the user-selected command to enter the launch control mode is includes a target speed setpoint, wherein target speed setpoint is one of a vessel speed or a rotational speed and wherein the first threshold vessel condition is less than or equal to the target speed setpoint.

9. The method of claim 1, wherein the user-selected command further includes selection to engage automatic propulsion control.

10. The method of claim 1, further comprising controlling the trim actuator to begin trimming up the marine drive to the predetermined target trim position upon expiration of a predetermined time after the marine vessel has reached the first threshold vessel condition.

11. The method of claim 1, further comprising detecting that the vessel condition of the marine vessel has reached a second threshold vessel condition and then controlling the trim actuator to trim down the marine drive to the minimum running trim position, wherein the first threshold vessel condition and the second threshold vessel condition are both one of a threshold vessel speed or a threshold rotational speed, and wherein the second threshold vessel condition is less than or equal to the first threshold vessel condition.

12. A system for automatically controlling trim position of a marine drive on a marine vessel, the system comprising:

a trim actuator configured to rotate the marine drive about a trim axis to position the marine drive at trim positions between a minimum running trim position and a maximum running trim position;

a control system configured to:

receive a user-selected command to enter a launch control mode;

control the trim actuator to position the marine drive in a tucked position, wherein the tucked position is between a vertical trim position and the minimum running trim position;

detect that a vessel condition has reached a first threshold vessel condition; and after the marine vessel reaches the first threshold vessel condition, control the trim actuator to trim up the marine drive to a predetermined target trim position to generate a wave behind the marine vessel, wherein the predetermined target trim position is between the vertical trim position and a maximum running trim position.

13. The system of claim 12, wherein the first threshold vessel condition is at least one of a threshold vessel speed, a threshold rotational speed, a threshold load, and a threshold vessel pitch.

14. The system of claim 13, wherein the control system receives a rotational speed of a drive shaft of the marine drive from a speed sensor, and wherein the first threshold vessel condition includes the threshold rotational speed being a threshold speed of the drive shaft.

15. The system of claim 13, wherein the first threshold vessel condition includes the threshold rotational speed being an engine RPM or a motor RPM of the marine drive.

16. The system of claim 13, wherein the first threshold vessel condition includes the threshold load being an engine load or a motor load of the marine drive.

17. The system of claim 12, wherein the first threshold vessel condition includes a threshold vessel speed between 8 and 15 mph.

18. The system of claim 12, wherein the user-selected command to enter the launch control mode is includes a target speed setpoint, wherein target speed setpoint is one of a vessel speed or a rotational speed and wherein the first threshold vessel condition is less than or equal to the target speed setpoint.

19. The system of claim 12, wherein the controls system is further configured to control the trim actuator to begin trimming up the marine drive to the predetermined target trim position upon expiration of a predetermined time after the marine vessel has reached the first threshold vessel condition.

* * * * *